US009139400B2

(12) United States Patent
Shakal et al.

(10) Patent No.: US 9,139,400 B2
(45) Date of Patent: Sep. 22, 2015

(54) HOSE REEL LATCH

(75) Inventors: Anthony J. Shakal, Crystal, MN (US); Scott F. Hill, Maple Grove, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 259 days.

(21) Appl. No.: 13/522,466

(22) PCT Filed: Jan. 14, 2011

(86) PCT No.: PCT/US2011/021294

§ 371 (c)(1), (2), (4) Date: Jul. 16, 2012

(87) PCT Pub. No.: WO2011/088316

PCT Pub. Date: Jul. 21, 2011

(65) Prior Publication Data

US 2012/0292418 A1 Nov. 22, 2012

Related U.S. Application Data

(60) Provisional application No. 61/294,913, filed on Jan. 14, 2010.

(51) Int. Cl.

| | |
|---|---|
| ***B65H 23/04*** | (2006.01) |
| ***B65H 75/38*** | (2006.01) |
| ***B65H 75/14*** | (2006.01) |
| ***B65H 75/44*** | (2006.01) |

(52) U.S. Cl.

CPC ..... *B65H 75/38* (2013.01); *B65H 75/14* (2013.01); *B65H 75/4402* (2013.01); *B65H 75/4434* (2013.01); *B65H 2701/33* (2013.01); *B65H 2701/5114* (2013.01)

(58) Field of Classification Search

CPC ..... B65H 75/4402; B65H 75/4434; B65H 2701/33

USPC ..... 242/377, 396.4, 397.2, 385.2–385.3; 137/355.26–0.27

See application file for complete search history.

(56) References Cited

U.S. PATENT DOCUMENTS

| | | | | | |
|---|---|---|---|---|---|
| 2,907,534 | A | * | 10/1959 | Benstein | 242/397.2 |
| 3,176,931 | A | * | 4/1965 | Hannay | 242/376.1 |
| 4,543,982 | A | * | 10/1985 | Wolfe | 137/355.21 |
| 5,787,923 | A | | 8/1998 | Shea et al. | |
| 7,150,425 | B2 | * | 12/2006 | Banaszkiewicz et al. | 242/385.3 |

(Continued)

FOREIGN PATENT DOCUMENTS

| | | | |
|---|---|---|---|
| JP | 07-315697 | A | 12/1995 |
| JP | 08-048464 | A | 2/1996 |
| JP | 2009-215145 | A | 8/1997 |

(Continued)

OTHER PUBLICATIONS

The extended European Search Report in related European Application No. 11733439.1 filed Jan. 14, 2011.

(Continued)

*Primary Examiner* — Sang Kim
(74) *Attorney, Agent, or Firm* — Kinney & Lange, P.A.

(57) ABSTRACT

A hose reel has a latch assembly for catching a ratchet element on a hose reel spool. The hose reel includes a hose reel frame and a hose reel guide arm, both of which are capable of mounting the latch assembly.

17 Claims, 10 Drawing Sheets

(56) References Cited

U.S. PATENT DOCUMENTS

| | | | | |
|---|---|---|---|---|
| 7,669,795 | B2 * | 3/2010 | Brown | 242/397 |
| 2004/0238675 | A1 | 12/2004 | Banaszkiewicz et al. | |

FOREIGN PATENT DOCUMENTS

| | | | |
|---|---|---|---|
| JP | 09-295768 | A | 11/1997 |
| JP | 11286374 | A | 10/1999 |
| JP | 2000-218091 | A | 8/2000 |
| JP | 2001-112157 | A | 4/2001 |
| JP | 2001-294368 | A | 10/2001 |
| JP | 2004-075102 | A | 3/2004 |
| JP | 2005-330057 | | 12/2005 |
| KR | 20-1998-0010474 | | 5/1998 |
| KR | 20-0277539 | Y1 | 6/2002 |

OTHER PUBLICATIONS

International Search Report, mailed Sep. 28, 2011.

* cited by examiner

HOSE REEL LATCH

Reference is made to PCT application No. PCT/US11/21298 (now U.S. non-provisional application Ser. No. 13/522,472), entitled "HOSE REEL FRAME AND GUIDE ARM," filed on even date with this application by inventors Anthony Shakal and John Holman, and to PCT application No. PCT/US11/21289 (now U.S. non-provisional application Ser. No. 13/522,461), entitled "HOSE REEL SPOOL," filed on even date with this application by inventor Anthony Shakal.

BACKGROUND

The present invention relates generally to hose reels, and more particularly to hose reel latch attachment.

Hose reels are commonly used to consolidate fluid-carrying hoses. Wound hoses take up less space, and are less likely to become entangled with surroundings. Industrial hose reels are often biased with torsion springs or counterweights to automatically wind up in the absence of an extending force on the hose attached to the reels.

Hose reels commonly comprise three primary components: a spool, a frame, and a guide arm. Hose reel spools typically comprise a hub with a cylindrical wall and axially opposite side walls. The side walls and cylindrical wall together define an annular retaining area in which wound hose is stored. An anchored end of a hose is usually passed through or attached to a hose mount on the cylindrical wall. This hose mount is commonly angled to prevent the hose from bending excessively when it coils about the spool. Many hose reels also include a frame or stand which supports and anchors the spool. Such frames may attach to one or both sides of the spool. Hose frames must be able to support the full weight of a spool loaded with hose, as well as any strains associated with winding and unwinding the hose. Some hose reels also include guide arms to direct the spooling of the hose, thereby ensuring that the hose coils properly onto the spool. Like frames, guide arms may attach to one or both sides of the hose reel. Most guide arms are rotatably attached, so as to allow the hose to be spooled and unspooled at a range of angles.

In the past, some hose reels have included ratcheting latch assemblies to prevent hose reels from retracting or re-spooling the hose while in use. These latch assemblies typically include a pawl on one of either the hose reel frame or the guide arm, and a toothed ratchet element affixed to one side of the spool. Previous hose reels have included mounts for a pawl on either the frame or the guide arm, but not both, typically due to the increased cost and manufacturing time required. The pawl engages the ratchet element to limit rotation of the spool, preventing it from spooling. With such latch assemblies, a latched hose is retracted by first unspooling the hose slightly to disengage the ratcheting element from the pawl. This can prove difficult if a pawl engages while the hose is fully unspooled. In such a case, it may not be possible to unlatch and re-spool the hose without disassembling the hose reel. It is possible to ensure that this situation never arises by manufacturing the ratchet element on the radially opposite side of the spool from the hose mount, and installing the pawl on the guide arm. When the hose is fully unspooled, the hose mount will align radially with the guide arm. As a result, a pawl mounted on the guide arm can never engage a ratchet element opposite the hose mount while the hose is fully extended. This solution is not available where the hose reel does not include a guide arm. In applications where the guide arm is ommitted to save expense, weight, or space, the latch must be mounted elsewhere, or not at all.

Hose reels are preferably strong, compact, and easily assembled. In the past, hose reel frames have sometimes been constructed with axially outward-extending support flanges, and hose reel spools have sometimes been constructed with axially outward-angled dished side walls. Such constructions provide additional strength, but are bulkier than a flat spool, and therefore necessitate a larger frame with a wider footprint. Ease of assembly is important both during and after manufacture; in particular, it is desirable that hose reels be easily adaptable to different working conditions and applications.

SUMMARY

The present invention is directed toward a hose reel with a latch assembly for catching a ratchet element affixed to a hose reel spool. The hose reel includes a hose reel frame and a hose reel guide arm, both of which include hookups for mounting the latch assembly.

DETAILED DESCRIPTION

I. Overview

Figure 1A:
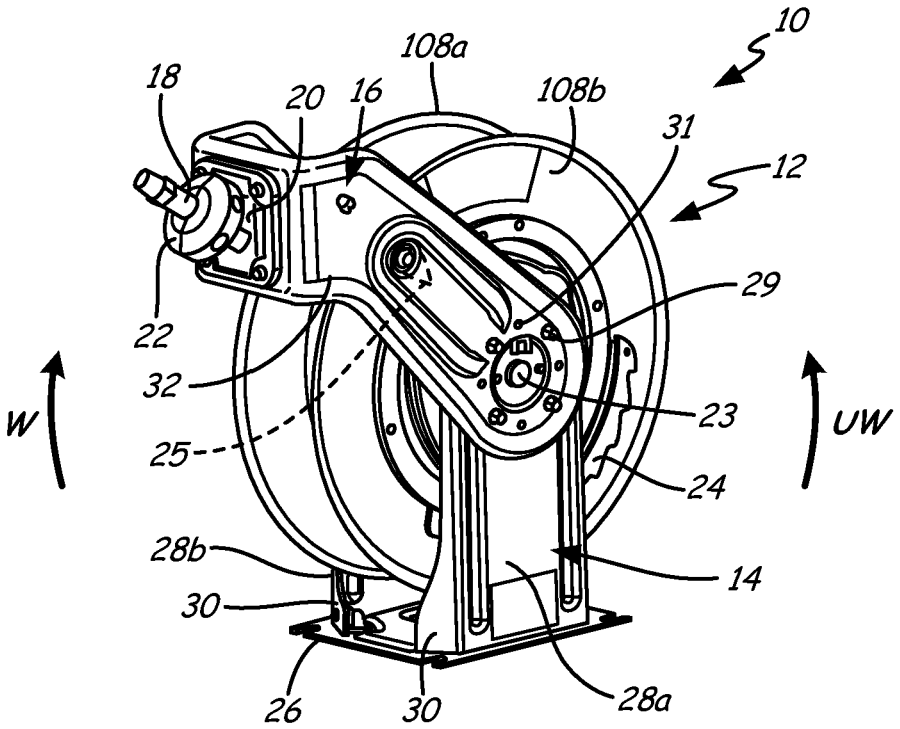
FIGS. 1*a* and 1*b* are perspective views of a hose reel frame and guide arm of the present invention, together with a hose reel spool.
Figure 1B:
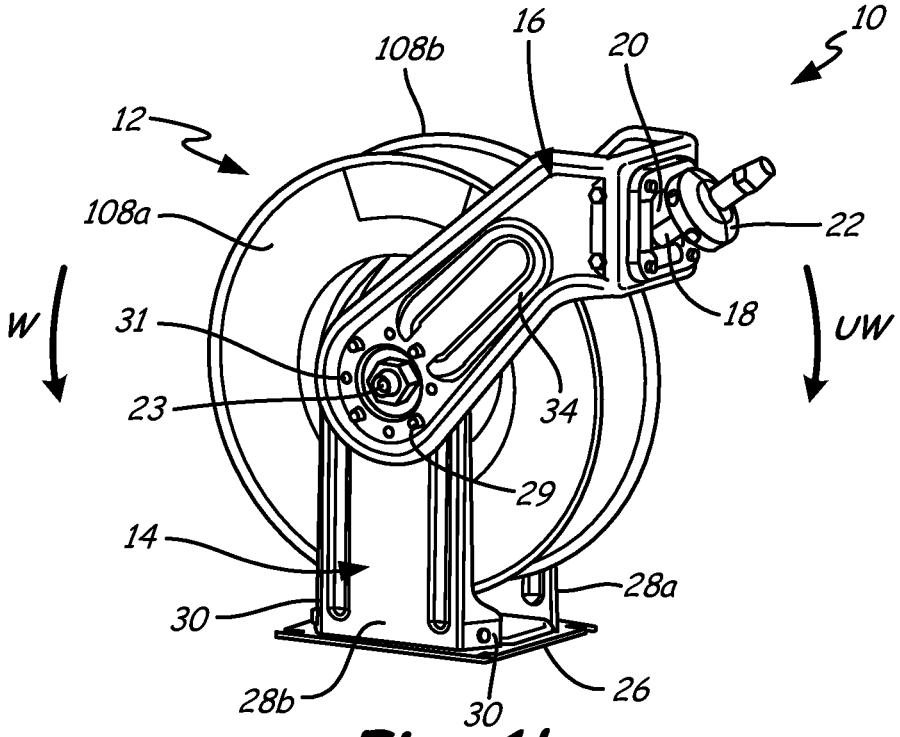

FIGS. 1*a* and 1*b* depict hose reel assembly 10 comprising spool 12 (with side walls 108*a* and 108*b*), frame 14 (with frame base 26 and frame sides 28*a* and 28*b* having flanges 30 and studs 29), guide arm 16 (with L-shaped piece 32 and I-shaped piece 34, each having holes or indents 31), hose 18, hole 20, anchor 22, mounting hardware 23, ratchet element 24, and pawl 25 (drawn in phantom behind guide arm 16). FIGS. 1*a* and 1*b* also illustrate winding direction W and unwinding direction UW. Spool 12 rotates to spool and unspool hose 18 wound about a central cylindrical surface and between the sides of spool 12.

Spool 12 comprises axial hub 104 (not visible in FIGS. 1*a* or 1*b;* see FIG. 2) and radially extending first side wall 108*a*, and second side wall 108*b*. As depicted, spool 12 turns in winding direction W to spool and unwinding direction UW to unspool hose 18. In other embodiments, spool 12 may be manufactured to spool and unspool hose 18 in the opposite directions. Frame 14 supports spool 12 and guide arm 16. Guide arm 16 extends from frame 14 to retain hose 18 as shown. Spool 12 is rotatably attached to frame 14 by mounting hardware 23, which in some embodiments is a central axle or pin running through spool 12, frame sides 28*a* and 28*b*, and pieces 32 and 34 of guide arm 16. In one embodiment, spool 12 is biased (by, for example, a torsion spring) to rotate in winding direction W in the absence of a contrary force, thereby spooling hose 18. Sides 108*a* and 108*b* of spool 12 angle axially inward as they extend radially outward, with side 108*a* angled toward side 108*b*, and vice versa. This angled construction strengthens spool 12 and avoids contact between side walls 108*a* and 108*b*, and flanges 30 (discussed below).

Frame 14 comprises horizontal frame base 26 and vertical frame sides 28*a* and 28*b*. Frame sides 28*a* and 28*b* are anchored to frame base 26, which forms the foundation of frame 14. Frame side 28*a* is welded to frame base 26 to form a single L-shaped frame piece. Frame side 28*b* is not welded to frame base 26, but is fastened to frame base 26 when frame 14 is assembled. The L-shaped piece comprising frame side 28*a* and frame base 26 combines with frame side 28*b* (an I-shaped piece) to form the U-shape of frame 14. Frame sides 28*a* and 28*b* support spool 12 and guide arm 16 via mounting hardware 23, as previously discussed. Base 26 does not extend axially wider than guide arm 16. Frame sides 28*a* and 28*b* incorporate flanges 30 to strengthen frame 14. Flanges 30 are located on the interior faces of sides 28*a* and 28*b*, and are widest at frame base 26, tapering vertically into frame sides 28*a* and 28*b*. Because flanges 30 are located on the interior faces of sides 28*a* and 28*b*, flanges 30 contribute no additional width to hose reel 10. As previously discussed, sides 108*a* and 108*b* of spool 30 angle axially inward toward each other, thereby avoiding contact with flanges 30.

Guide arm 16 is also attached to frame 14, and rotates about the axis of spool 12, but independently from spool 12. Guide arm 16 may be attached directly to frame 14 via one or more fasteners, or anchored to frame 14 by mounting hardware 23. In one embodiment, studs 29 are arranged in a circular array on frame 14, and couple to holes or indents 31 in guide arm 16 to anchor guide arm 16 at a range of predefined angles. The free end of hose 18 passes through hole 20 in guide arm 16, but cannot fully retract into spool 12 because of anchor 22 on hose 18, which is too large to fit through hole 20. Anchor 22 may be a rubber or plastic block secured about hose 18. Guide arm 16 is comprised of two pieces: L-shaped piece 32, comprising one side and the front of guide arm 16, and I-shaped piece 34, comprising the opposite side of guide arm 16. L-shaped piece 32 and I-shaped piece 34 are fastened together to form guide arm 16, as shown.

Ratchet element 24 is affixed to spool 12, and interfaces with pawl 25 on guide arm 16 to prevent hose 18 from retracting undesirably. Ratchet element 24 spans only a partial radial arc of spool 12, as shown, and therefore only aligns with pawl 25 for a fraction of each rotation of spool 12. When ratchet element 24 rotates in the UW direction into alignment with pawl 25, pawl 25 catches with ratchet element 24, exerting a counter-rotational force which prevents rotation of spool 12 in the W direction. When ratchet element 24 is unaligned with pawl 25, or rotates into in the W direction into alignment with pawl 25, pawl 25 does not catch on ratchet element 24, and does not prevent spool 12 from rotating in either direction. Although pawl 25 is shown mounted on guide arm 16 in FIG. 1*a*, pawl 25 may alternatively be mounted on frame 14.

II. Spool 12

Figure 2:
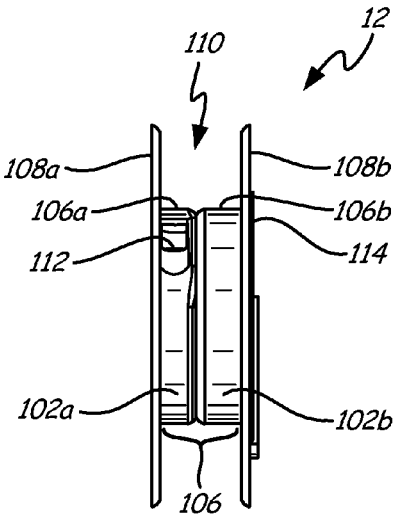
FIG. 2 is a front view of the spool shown in FIGS. 1*a* and 1*b*.

FIG. 2 is a front view of spool 12 (with spool halves 102*a* and 102*b*) comprising axial hub 104 (with outer cyllindrical wall 106 having hose mount 112), side wall 108*a* (with outer annular lip 118*a*), and side wall 108*b* (with outer annular lip 118*b* and annular ridge 114). Outer cylindrical wall 106 and side walls 108*a* and 108*b* together define annular hose retention area 110.

As previously stated, spool 12 is comprised of axial hub 104 and side walls 108*a* and 108*b*. Axial hub 104 comprises inner end wall 120 (not visible in FIG. 2; see FIG. 3) and outer cylindrical wall 106. Outer cylindrical wall 106 is the radially outermost cylindrical portion of axial hub 104. Side walls 108*a* and 108*b* are annular flanges which extend radially outward from the edges of outer cylindrical wall 106. Together with side walls 108*a* and 108*b*, outer cylindrical wall 106 defines hose retention area 110, an annular space into which hose 18 coils for storage. In one embodiment, spool 12 is formed in two halves. First spool half 102*a* includes first side wall 108*a* and outer cylindrical wall portion 106*a*. Second spool half 102*b* includes second side wall 108*b* and outer cylindrical wall portion 106*b*. Spool 12 is formed by welding or screwing together first spool half 102*a* and second spool half 102*b*.

Hose 18 mounts on outer cylindrical wall 106 at hose mount 112, which is angled counterclockwise so as not to excessively bend hose 18 where it connects to hose mount 112. In one embodiment, hose mount 112 is a passage through cylindrical wall 106 through which hose 18 is threaded. In another embodiment, hose mount 112 is an attachment point for one end of hose 18, and axial hub 104 further comprises connection apparatus to route fluid from a fluid source into hose 18. In one embodiment, ratchet element 24 is mounted on a radially opposite side of spool 12 from hose mount 112 to avoid locking of ratchet element 24.

When hose is spooled onto spool 12 through hole 20 of guide arm 16 (see FIGS. 1*a* and 1*b*), it piles up naturally in a pyramidal shape seldom more than four hose widths wide at outer cylindrical wall 106, and generally narrower as it stacks radially outward. Outer cylindrical wall 106 is therefore designed to be only slightly more than four hose widths wide, since additional width would increase the bulk of hose reel assembly 10 without benefit.

Annular ridge 114 extends axially outward from outer cylindrical wall 106 to provide a radially flat surface for the attachment of a cover (not shown) for spool 12. Annular ridge 114 is described in greater detail along with FIG. 3. Side walls 108*a* and 108*b* are angled axially inward as they extend radially outward: side wall 108*a* is angled toward side wall

108*b*, and vice versa. This angled construction strengthens spool 12 without increasing spool width.

Figure 3:
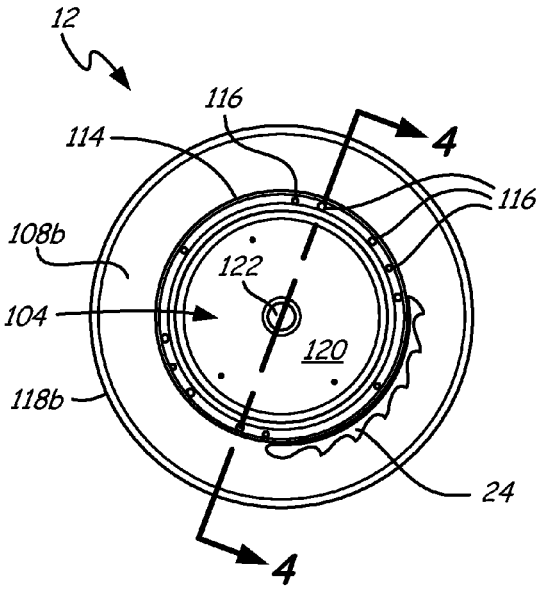
FIG. 3 is a side view of the spool of FIGS. 1*a*, 1*b* and 2.

FIG. 3 is a side view of spool 12, showing side wall 108*b*, annular ridge 114, mounting holes 116, outer annular lip 118*b*, inner end wall 120 with mounting location 122, and ratchet element 24. As previously discussed, axial hub 104 comprises inner end wall 120 and outer cylindrical wall 106. Inner end wall 120 is a flat radial surface spanning the interior of spool 12, radially inward of cylindrical wall 106 (see FIG. 2). Inner end wall 120 also includes mounting location 122. Mounting hardware 25 is secured at mounting location 122 to support spool 12 on frame 14. In one embodiment, mounting hardware 24 is a shaft or pin, and mounting location 122 is a passage through inner end wall 120, though which mounting hardware fits. Mounting location 122 is described in greater depth below. Annular ridge 114 is a region of side wall 108*b* through which mounting holes 116 are bored. Holes 116 allow a cover (not shown) to be screwed or riveted to side wall 108*b* at annular ridge 114, if so desired. Annular ridge 114 is located at one end of outer cylindrical wall 106, and extends directly radially outward from outer cylindrical wall 106 so as to provide a flat mounting surface for the cover. Although annular ridge 114 is shown on side 108*b*, it could instead be located on side 108*a*.

The radially outer extents of side walls 108*a* and 108*b* turn axially outward in outer annular lips 118*a* and 118*b*, which strengthen spool 12. Second side wall 108*b* ends in second outer annular lip 118*b*, which turns axially away from hose retaining area 110 and first side wall 108*a*. Analogously, first side wall 108*a* (not visible in FIG. 3; see FIGS. 2 and 4) ends in first outer annular lip 118*a*, which turns axially away from hose retaining area 110 and second side wall 108*b*. Because side walls 108*a* and 108*b* angle axially inward as they extend radially outward, outer annular lips 118 do not add to the overall width of spool 12. Ratchet element 24 is screwed or riveted to side wall 108*b* to interact with pawl 25, as discussed previously. FIG. 3 also shows cross section line 4-4, which passes through the axis of spool 12.

Figure 4:
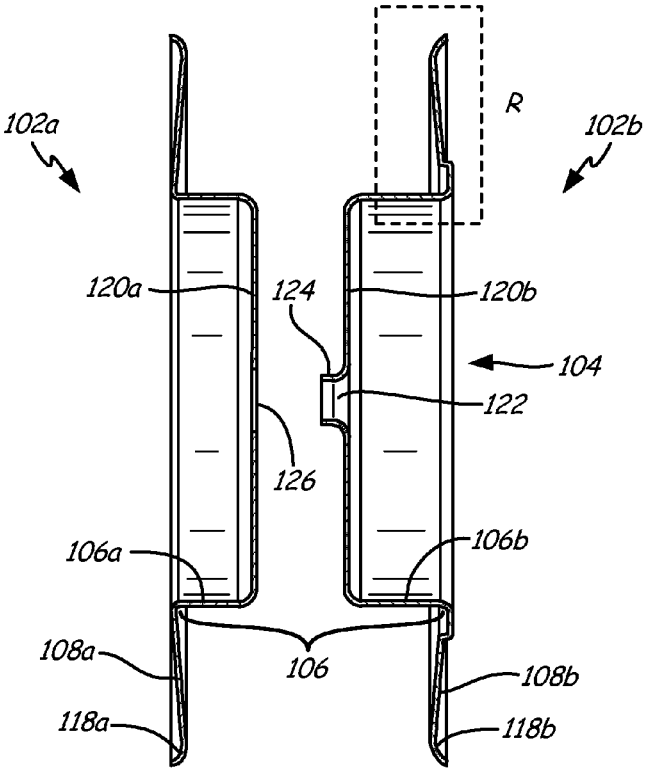
FIG. 4 is an exploded cross-sectional view of the spool along cross-section 4-4 of FIG. 3.

FIG. 4 is an exploded cross-sectional view of spool 12 along cross-section line 4-4 from FIG. 3. FIG. 4 depicts spool 12, including outer cylindrical wall 106, side walls 108*a* and 108*b*, outer annular lips 118*a* and 118*b*, inner end wall sections 120*a* and 120*b*, and mounting location 122, collar 124, and hole 126. FIG. 4 shows spool halves 102*a* and 102*b* exploded for clarity. When spool 12 is assembled, spool halves 102*a* and 102*b* are attached together, as previously discussed. Mounting hardware 25 passes through mounting location 122 to anchor spool 12 to frame 14.

In embodiments wherein spool 12 is formed from two halves, inner end wall 120 may be split into two abutting sections: first inner end wall section 120*a* (which is a part of first spool half 102*a*) and second inner end wall section 120*b* (which is a part of second spool half 102*b*). These sections are bolted or welded together to connect spool half 102*a* to spool half 102*b*. In one embodiment, first inner end wall section 120*a* includes hole 126, and second inner end wall section 120*b* includes collar 124. Hole 126 is a central hole in second inner axial end wall section 120*a*, and is large enough to admit collar 124. Collar 124 is a central, axially extending portion of second inner axial end wall section 120*b* which passes though hole 126 and forms a journal for mounting hardware 25. In another embodiment, the location of collar 124 and hole 126 is reversed: collar 124 is located on first inner end wall section 120*a*, while hole 126 is located in second inner end wall section 120*b*. A bushing or bearing is inserted in collar 124 to support spool 12 as it spins.

As discussed previously, side walls 108 slope axially inward as they extend radially outward, for added strength. This inward slant is designed to match the aforementioned natural pyramidal stacking profile of hose 18 about inner annular ring 106, and therefore does not impede spooling. The radially outermost edge of first side wall 108*a* ends in first outer annular lip 118*a*, and the radially outermost edge of second side wall 108*b* ends in second outer annular ridge 118*b*. Outer annular ridges 118*a* and 118*b* further strengthen spool 12.

FIG. 4 also indicates region R, encompassing a section of outer cylindrical wall 106 and second side wall 108*b*.

Figure 5:
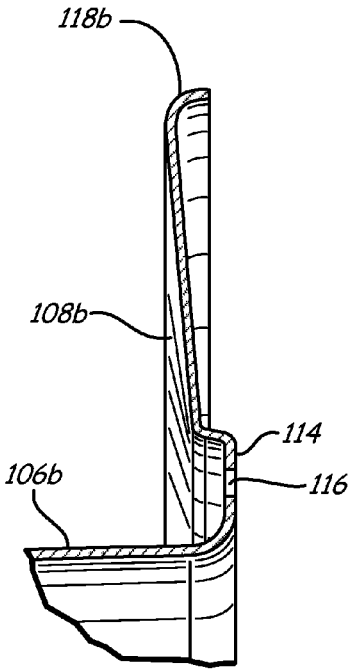
FIG. 5 is a close-up cross-sectional view of region R from FIG. 4.

FIG. 5 is an expanded view of region R from FIG. 4. FIG. 5 shows a portion of inner annular ring 106 and side wall 108*b* with outer annular lip 118*b*, annular ridge 114, and one mounting hole 116. Annular ridge 114 is formed by extending side wall 108*b* a short distance directly radially outward from the outermost extent of outer cylindrical wall 106, rather than slanting side wall 108*b* axially inward over the entire radial expanse from the intersection of inner annular ring 106*b* with side wall 108*a* to outer annular lip 118*a*. A spool cover can be attached to side wall 108*b* with bolts passing through mounting holes 116. As can be seen in FIG. 5, the axially inward slant of second side wall 108*b* prevents second outer annular lip 118*b* from adding to the axial bulk of spool 12. The same is true of first side wall 108*a* and first outer annular lip 118*a*. This compact design also enables flanges 30 (discussed above with respect to FIG. 1) to face axially inward without contacting side walls 108*a* or 108*b*, thereby further reducing the overall axial bulk of hose reel 10.

III. Frame 14

Figure 6:
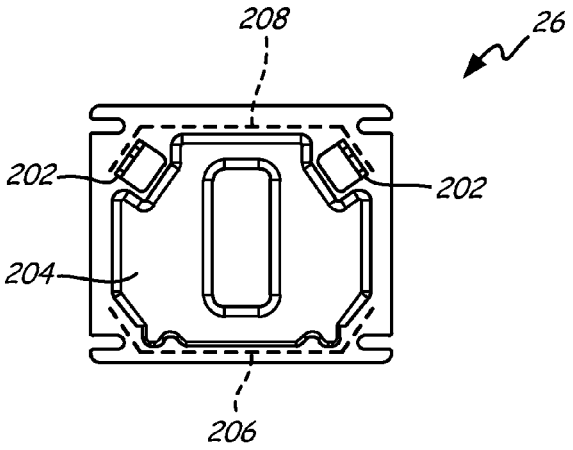
FIG. 6 is a plan view of a base of the hose reel frame of FIGS. 1*a* and 1*b*.

FIG. 6 is a plan view of frame base 26 from FIG. 1, depicting fastening tabs 202, ridged surface 204, first side attachment region 206, and second side attachment region 208. Frame base 26 is, in one embodiment, a sheet of pressed or cast metal. Frame side 28*a* is welded into place at first side attachment region 206. Frame side 28*b* is attached to frame base 26 at second side attachment region 208 via fasteners threaded through fastening tabs 202. Fastening tabs 202 are, in one embodiment, stamped from frame base 26 and bent at 90 degrees from base frame 26 to project parallel to frame side 28*b*. In another embodiment, fastening tabs 202 are separate metal pieces welded onto frame base 26. Ridged surface 204 is a raised region pressed or cast into frame base 26 to strengthen frame 14 against bending.

Figure 7A:
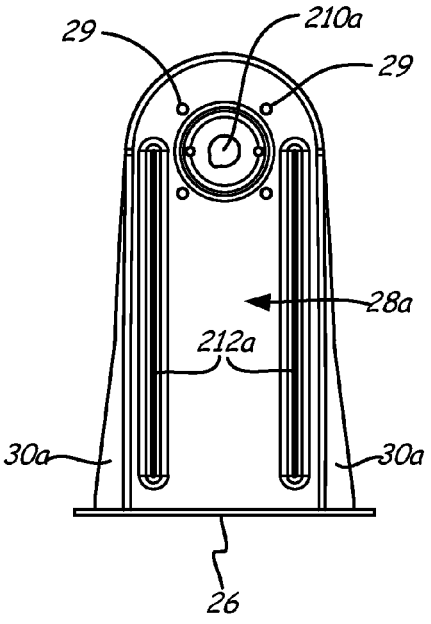
FIGS. 7*a* and 7*b* are side and front views, respectively, of the base and a side section of the hose reel frame of FIGS. 1*a* and 1*b*.
Figure 7B:
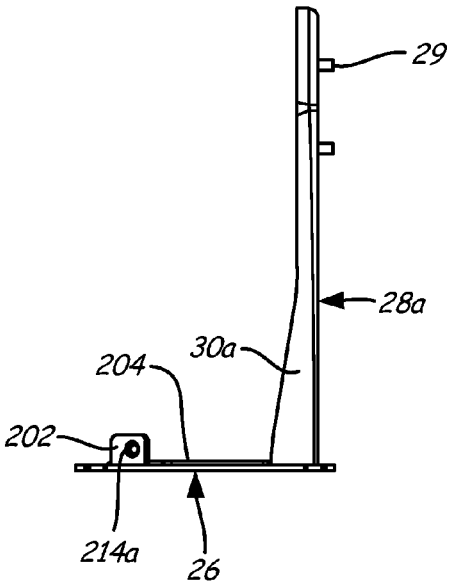

FIGS. 7*a* and 7*b* are exterior side and front views, respectively, of frame side 28*a* and frame base 26, connected to form an L-shaped piece. FIG. 3*a* depicts frame base 26, and frame side 28*a* having flanges 30*a*, mounting point 210*a*, ridges 212*a*, and studs 29. FIG. 3*b* depicts frame base 26 having ridged surface 204, fastening tabs 202 (with fastener holes 214), and frame side 28*a* (with flanges 30*a* and studs 29). Mounting hardware 23 attaches to or feeds through mounting point 210*a* to anchor spool 12. If mounting hardware 23 is an axle or shaft, for instance, mounting point 110*a* is a hole through which mounting hardware 23 passes. As previously described, flanges 30*a* strengthen frame 14 and support side 108*a*. Flanges 30*a* are angled diagonally inward toward the interior of hose reel assembly 10, as indicated by first side attachment region 206 on FIG. 6. Ridges 212*a* further strengthen frame side 28*a* against bending. As shown in FIG. 2*a*, ridges 212*a* comprise corrugations that extend into side 28*a*. Fastening tabs 202 have fastener holes 214 to allow threaded fasteners to pass through fastening tabs 202 to secure frame side 28*b* (see FIGS. 1*a* and 1*b*). Studs 29 help to secure guide arm 16 to frame 14, as described below with respect to FIGS. 10*a-d*.

Figure 8:
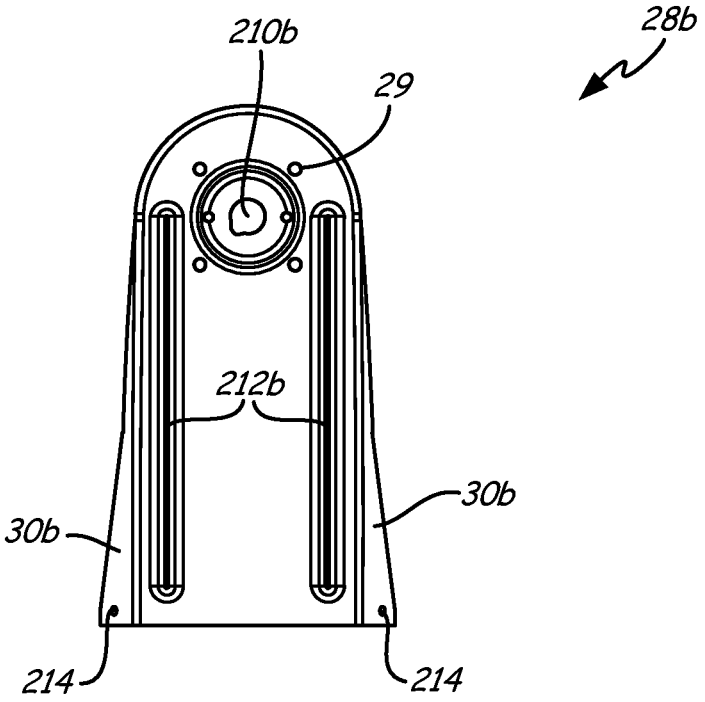
FIG. 8 is a side view of another side section of the hose reel frame of FIGS. 1*a* and 1*b*.

FIG. 8 is an exterior side view of frame side 28*b*, depicting flanges 30*b*, mounting point 210*b*, ridges 212*b*, and fastener holes 214*b*. Flanges 30*b* and ridges 212*b* strengthen frame side 28*b* just as flanges 30*a* and ridges 212*a* strengthen frame side 28*a*. Mounting hardware 23 attaches to or feeds through mounting points 210*a*, thereby connecting spool 12 to both sides of frame 14. Fastener holes 214*b* in flanges 30*b* allow frame side 28*b* to be mounted on fastening tabs 102. Fasteners 216 (not shown on FIG. 8; see FIG. 9) pass through fastener holes 214 to secure frame side 28*b* to frame base 26, holding frame side 28*b* in side attachment region 208 of FIG. 6. Fasteners 216 may be bolts, screws, or other threaded fasteners.

Figure 9:
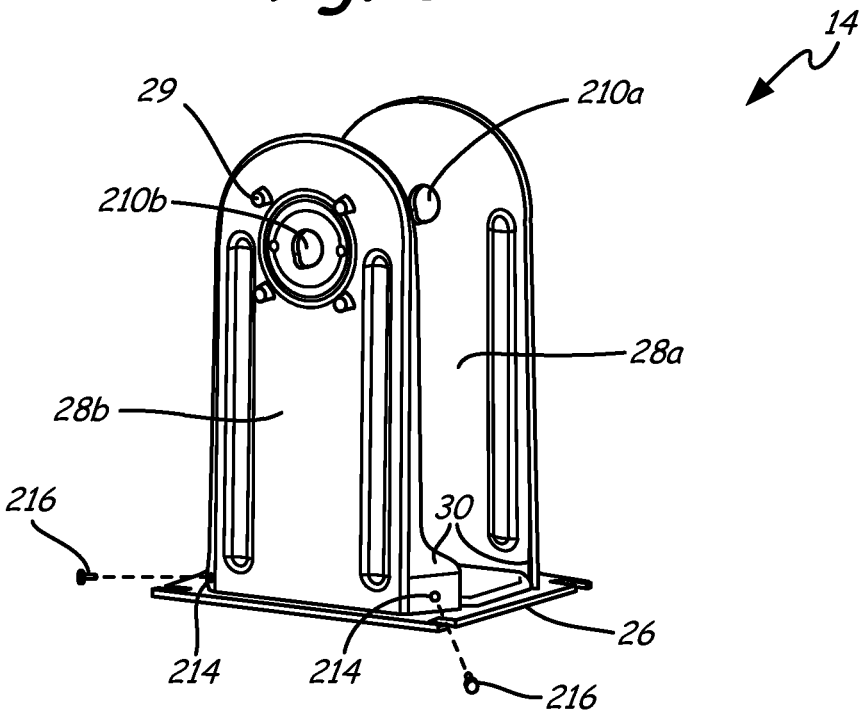
FIG. 9 is a perspective view of an assembled hose reel frame of FIGS. 1*a* and 1*b*.

FIG. 9 is a perspective view of frame 14, comprising frame base 26, frame sides 28*a* and 28*b* (with mounting points 210*a* and 210*b*, respectably, and studs 29), fastener holes 214, and fasteners 216. As previously discussed, frame side 28*a* is welded to frame base 26 to form an L-shaped piece. Frame side 28*b* is attached to this L-shaped piece by inserting fasteners 216 through fastener holes 214*a* (not visible) and 214*b*. This construction simplifies the mounting of spool 12 (via mounting hardware 23 attached to or fed through mounting points 210*a* and 210*b*). Frame sides 28*a* and 28*b* together lock spool 12 in position (leaving spool 12 free to rotate) whenever frame side 28*b* is secured in place. Installing or removing spool 12 is accomplished by unscrewing fasteners 216 from fastener holes 214, removing mounting hardware 23 from mounting point 210*b*, and disengaging frame side 28*b* from frame base 26 and mounting hardware 23. Studs 29 interact with indents or holes 31 (see FIGS. 1*a* and 1*b*) to hold guide arm 16 in place relative to frame 14.

IV Guide Arm 16

FIGS. 10*a* through 10*d* illustrate L-shaped piece 32 of guide arm 16. FIGS. 10*a*, 10*b*, 10*c*, and 10*d* are interior side, front, top, and exterior side views of L-shaped piece 32, respectively.

Figure 10A:
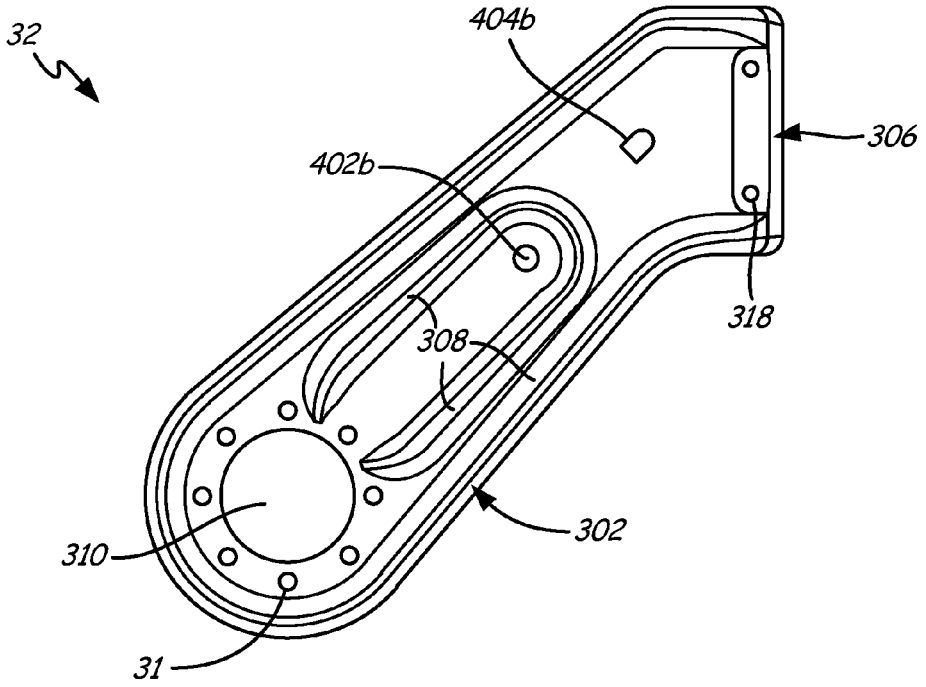
FIGS. 10*a*, 10*b*, 10*c*, and 10*d*, are left side, front, top, and right side views, respectably, of an L-shaped piece of the guide arm of FIGS. 1*a* and 1*b*.
Figure 10B:
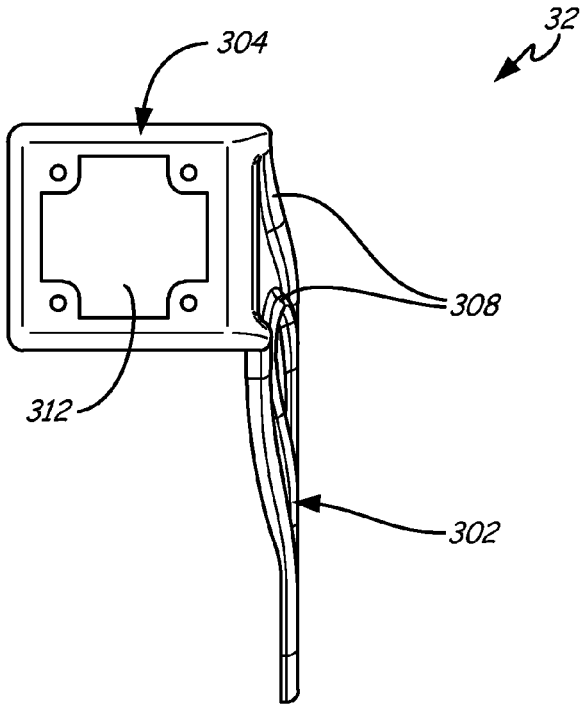
Figure 10C:
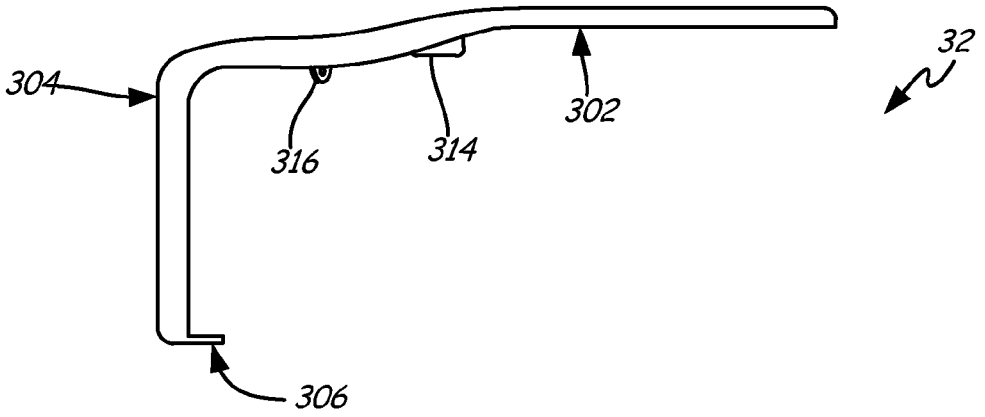
Figure 10D:
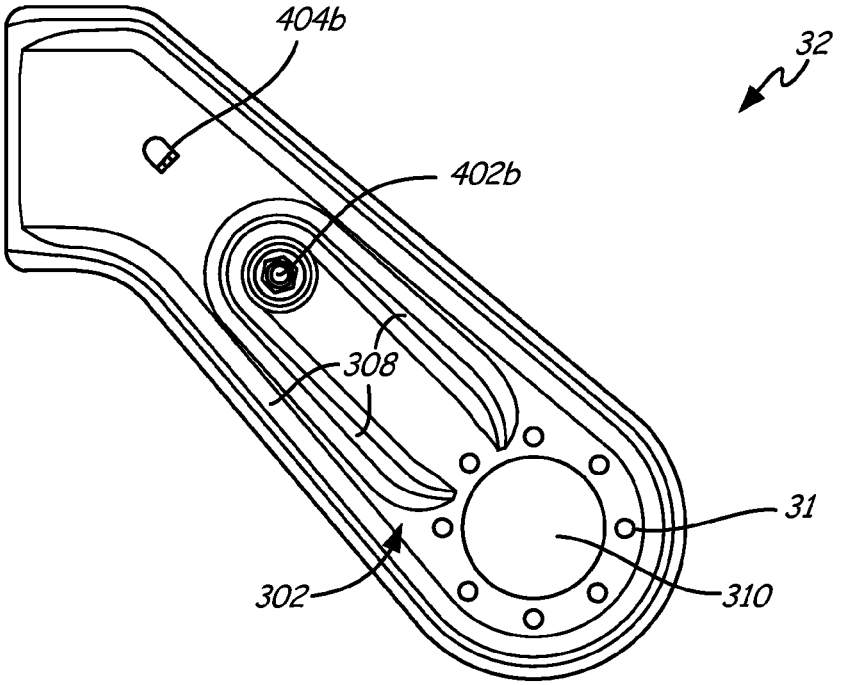

L-shaped piece 32 has side section 302 (with ridges 308, attachment area 310, pawl mount 402*b*, spring mount 404*b*, and holes 31), front section 304 (with front hole 312) and side tab 306 (with fastener holes 318). L-shaped piece 32 is attached to I-shaped piece 34 by threading fasteners 322 (see FIG. 12) through L-shaped piece 32 into fastener holes 320. Ridges 308 extend the length of side section 302, and strengthen guide arm 16 against bending. As shown in FIG. 10*a*, ridges 308 comprise corrugations that extend into side section 302.

Guide arm 16 is attached to frame 14 at attachment area 310. In one embodiment, holes 31 on guide arm 16 accept studs 29 on frame 14. Studs 29 and holes 31 are arranged in a circular array, and hold guide arm 16 in place at any of a range of predetermined angles with respect to spool 12. When L-shaped piece 32 is attached to I-shaped piece 34, guide arm 16 can rotate in discrete angular intervals about the axis of spool 12 (defined by mounting hardware 23), such that studs 29 supports guide arm 16 at a desired position. In some embodiments, guide arm 16 may be further or alternatively supported by clips or bolted fasteners, or may be anchored in place by mounting hardware 23.

Hose 18 passes through front hole 312, and is therefore constrained by guide arm 16 constrained to approach spool 12 from a limited range of angles. This forces hose 18 to spool in a regular, tidy fashion on spool 12, and prevents harmful loads from being applied to spool 12 or frame 14.

Pawl 25 (see FIGS. 1*a* and 1*b*) may be attached to guide arm 16 or frame 14 to restrict the rotation of spool 12. Pawl mount 402*b* is one mounting location for pawl 25, and spring mount 404*b* is one mounting location for a spring (not shown) which retains pawl 25 against ratchet element 24. Pawl 25 and its interaction with ratchet element 24 are described in greater detail with respect to FIGS. 13*a*-15*b*.

Figure 11A:
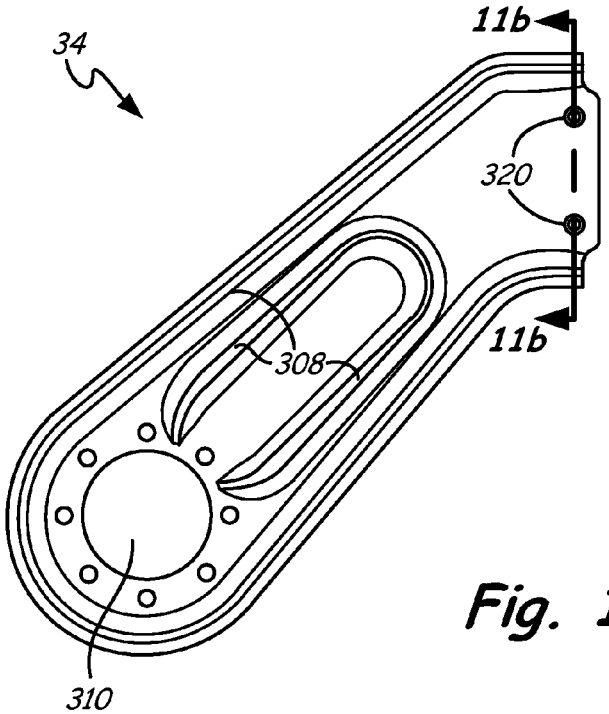
FIG. 11*a* is a side view of an I-shaped piece of the guide arm of FIGS. 1*a* and 1*b*.
Figure 11B:
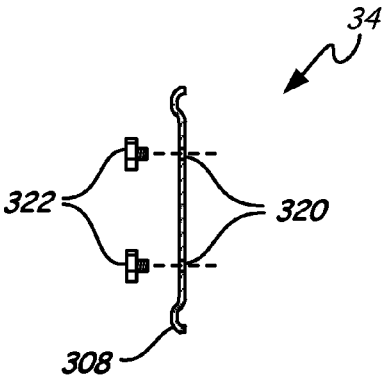
FIG. 11*b* is a cross-sectional view of the I-shaped guide arm piece of FIG. 11*a* along cross-section 11*b*-11*b*.

FIGS. 11*a* and 11*b* illustrate I-shaped piece 34 of guide arm 16. FIG. 11*a* is an exterior side view of I-shaped piece 34, indicating line 11*b*-11*b*. FIG. 11*b* is a cross-sectional view of I-shaped piece 34 taken through line 11*b*-11*b*.

I-shaped piece 34 has ridges 308, attachment area 310, fastener holes 320, fasteners 322, and holes 31. I-shaped piece 34 attaches to L-shaped piece 32 by securing fasteners 322 through fastener holes 318 and 320. In this fashion, L-shaped piece 32 and I-shaped piece 34 are joined together to form the guide-arm 14, which is U-shaped. Like L-shaped piece 32, I-shaped piece 34 incorporates ridges 308 for added strength, as shown, and attaches to frame 14 at attachment area 310. As shown in FIG. 11*a*, ridges 308 comprise corrugations that protrude from I-shaped piece 34. Holes 31 interact with studs 29 as described above, to retain guide arm 16. I-shaped piece 34 is similar to side section 304 of L-shaped piece 32, but lacks side pawl mount 402*b* and spring mount 402*b*, which are present on side section 304 of L-shaped piece 32.

Figure 12:
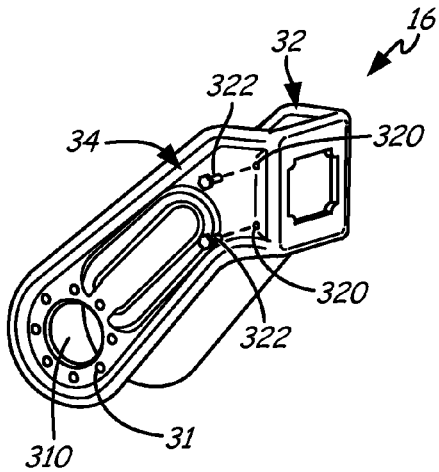
FIG. 12 is a perspective view of an assembled guide arm of the present invention.

FIG. 12 is a perspective drawing of assembled guide arm 16, showing L-shaped piece 32, I-shaped piece 34, attachment area 310, fastener holes 320, and fasteners 322. As previously discussed, guide arm 16 is assembled by fastening together L-shaped piece 32 and I-shaped piece 34. As with frame 14, this construction simplifies the mounting of spool 12: installing or replacing spool 12 requires only that I-shaped piece 34 and (I-shaped) frame piece 28*b* be disengaged while spool 12 is removed or replaced.

Although frame 14 and guide arm 16 have been described as substantially symmetric U-shaped structures, they may alternatively be manufactured as L-shaped, asymmetric parts. In such an embodiment, frame 14 does not include frame side 28*b*, and guide arm 16 does not include I-shaped piece 34. Frame 14 attaches to spool 12 and guide arm 14 on only one side, and mounting hardware 23 must therefore be an asymmetric pin or cantilevered shaft, rather than a shaft or axle supported on both sides of spool 12. This embodiment trades some degree of frame strength for simpler installation and removal of spool 12.

V. Latch Assembly 400

Figure 13A:
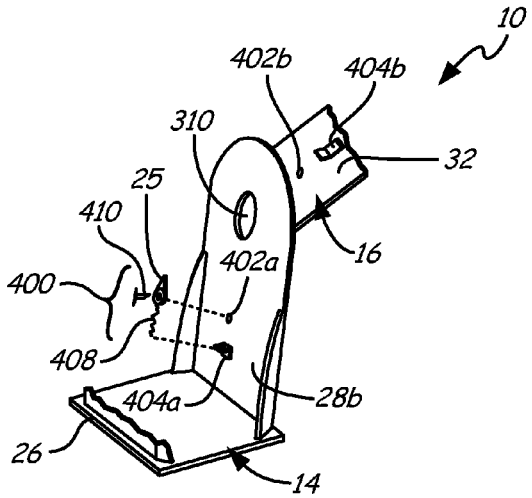
FIG. 13*a* is a partial perspective view of the hose reel frame and guide arm of FIG. 1, showing locations for a latch assembly including a pawl.
Figure 13B:
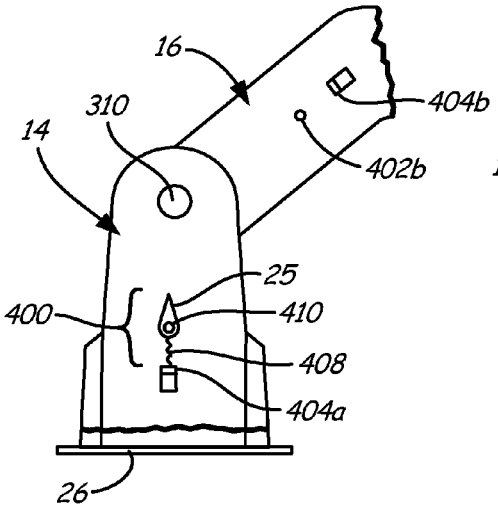
FIG. 13*b* is a partial side view of the hose reel frame and guide arm of FIG. 13*a*, showing the latch assembly of FIG. 13*a* attached to the hose reel frame.
Figure 13C:
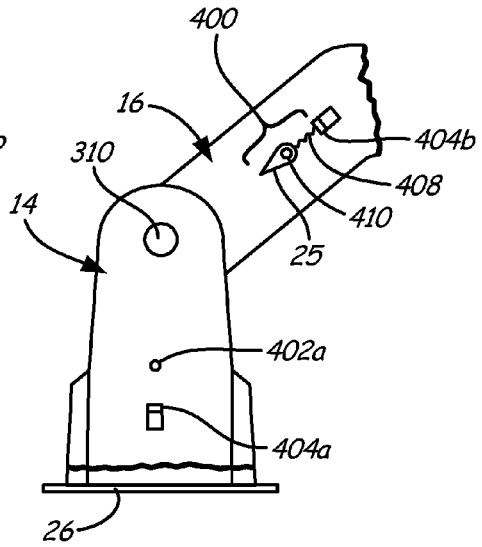
FIG. 13*c* is a partial side view of the hose reel frame and guide arm of FIG. 13*a*, showing the latch assembly of FIG. 13*a* attached to the guide arm.

FIG. 13*a* is a partial perspective view of hose reel assembly 10, omitting spool 12 and showing frame 14 and guide arm 16 with parts removed. Side 28*a* of frame 14 is not shown, and only a part of L-shaped piece 32 of guide arm 16 is shown. FIGS. 13*b* and 13*c* are side views of FIG. 13*a*. FIG. 13*b* shows pawl 25 mounted on frame 14, while FIG. 13*c* shows pawl 25 mounted on guide arm 16. Frame 14 comprises base 26 and visible side 28*b* with pawl mount 402*a* and spring mount 404*a*. Guide arm 16 comprises attachment location 310 and visible L-shaped piece 32 (with pawl mount 402*b* and spring mount 404*b*). Latch assembly 400 comprises spring 408, bolt 410, and pawl 25, and can be affixed to either of frame 14 and guide arm 16.

Guide arm 16 is attached to frame 14 at attachment location 310. In one embodiment, mounting hardware 25 runs through attachment location 310 to secure guide arm 16 to frame 14. In another embodiment, guide arm 16 is attached to frame 14 by one or more pins. As discussed with respect to FIGS. 1*a* and 1*b*, studs 29 may anchor guide arm 16 with respect to frame 14.

Either of frame 14 and guide arm 16 can mount latch assembly 400. Pawl 25 can be mounted either on frame 14 or on guide arm 16 by inserting bolt 410 through pawl 25 into pawl mount 402*a* or 402*b*, respectively. Pawl 25 engages ratchet element 24, as discussed previously, to halt rotation of spool 12. Spring 408 attaches to pawl 25 and either spring mount 404*a* (if pawl 25 is mounted on frame 14) or spring mount 404*b* (if pawl 25 is mounted on guide arm 16). Spring mounts 404*a* and 404*b* are attachment points which anchor one end of spring 408. In one embodiment, spring mounts 404*a* and 404*b* are stamped tabs bent out from frame 14 and guide arm 16, respectively. By stretching between pawl 25 and spring mount 404*a* or 404*b*, spring 408 exerts a counter-rotational force on pawl 25 to keep pawl 25 engaged with ratchet element 24, as explained further in description accompanying FIGS. 15*a* and 15*b*.

Although pawl mounts 402*a* and 402*b* are shown on side 28*a* and L-shaped piece 32, respectively, pawl mounts 402*a* and 402*b* could equivalently be situated on side 28*b* and I-shaped piece 34, respectively. Attachment locations 402*a*, 402*b*, 404*a*, and 404*b* must all, however, be located on the same side of hose reel assembly 10 as ratchet element 24.

Figure 14A:
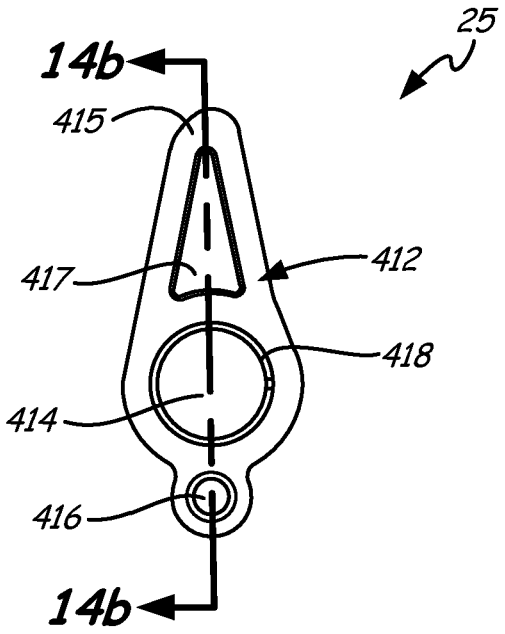
FIG. 14*a* is a side view of the pawl of FIG. 13*a*.
Figure 14B:
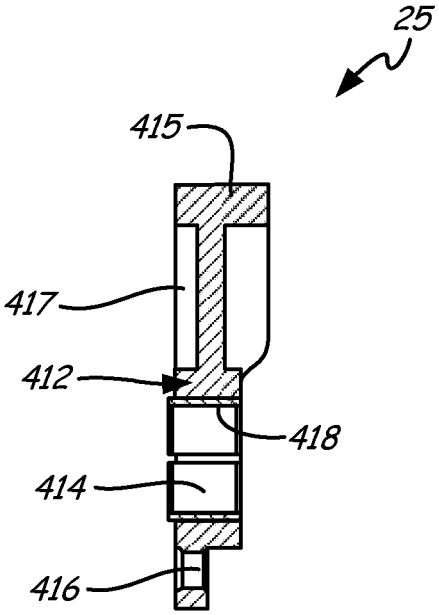
FIG. 14*b* is a cross-sectional view of the pawl of FIG. 13*a*.
Figure 14C:
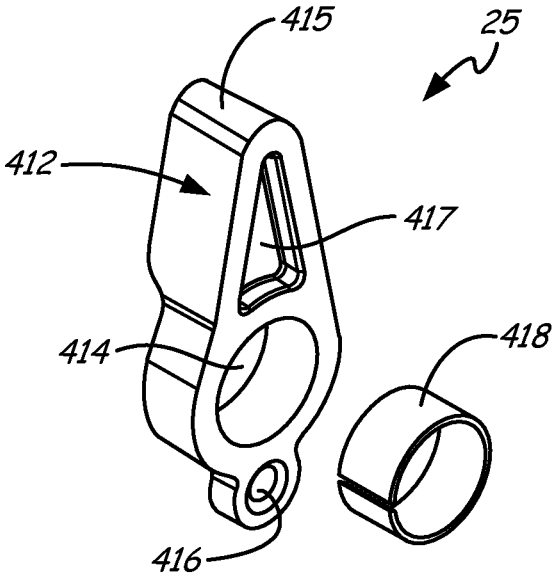
FIG. 14*c* is an exploded view of the pawl of FIG. 13*a*.

FIG. 14*a* is a front view of pawl 25, showing line 14*b*-14*b*. FIG. 14*b* is a cross-sectional view of pawl 25 through line 14*b*-14*b*. FIG. 14*c* is a perspective view of pawl 25 with bushing 418 (described below) exploded. FIGS. 14*a*, 14*b*, and 14*c* illustrate pawl 25, which comprises bushing 418 and pawl body 412 with attachment hole 414, tip 415, spring hole 416, and pocket 417. Pawl body 412 is formed, in one embodiment, of cast metal. Tip 415 is a substantially triangular tip of body 412, which has a wide edge for catching ratchet element 24. To conserve material and reduce weight, not all of pawl body 412 is as wide as tip 415; as seen in FIG. 14*a*, pawl body 412 is flanged with pocket 417 to reduce the bulk of pawl 25 without narrowing tip 415. Tip 415 engages teeth on ratchet element 24 as discussed with respect to FIGS. 15*a* and 15*b*. Bushing 418 may be inserted between bolt 410 (see FIGS. 13*a* and 13*b*) and pawl body 412, allowing pawl body 412 to rotate smoothly on bolt 410. Bolt 410 passes through bolt hole 414 (see FIGS. 14*a*, 14*b*, and 14*c*) to secure pawl 25 either to pawl mount 402*a* on frame 14 or to pawl mount 402*b* on guide arm 16. Spring 408 attaches to pawl 25 at spring hole 416. Pawl 25 can be mounted either on frame 14 or on guide arm 16, as illustrated in FIGS. 13*b* and 13*c*.

Figure 15A:
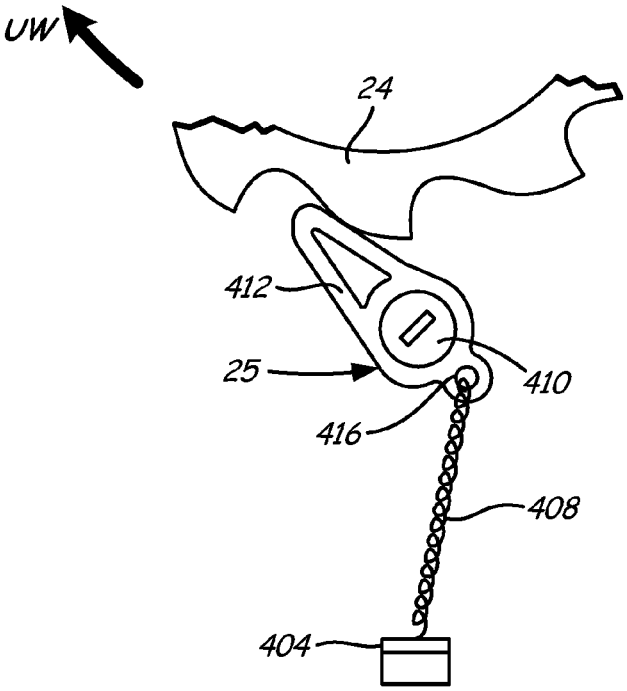
FIGS. 15*a* and 15*b* are isolated views of the latch assembly of FIGS. 13*a-c*.
Figure 15B:
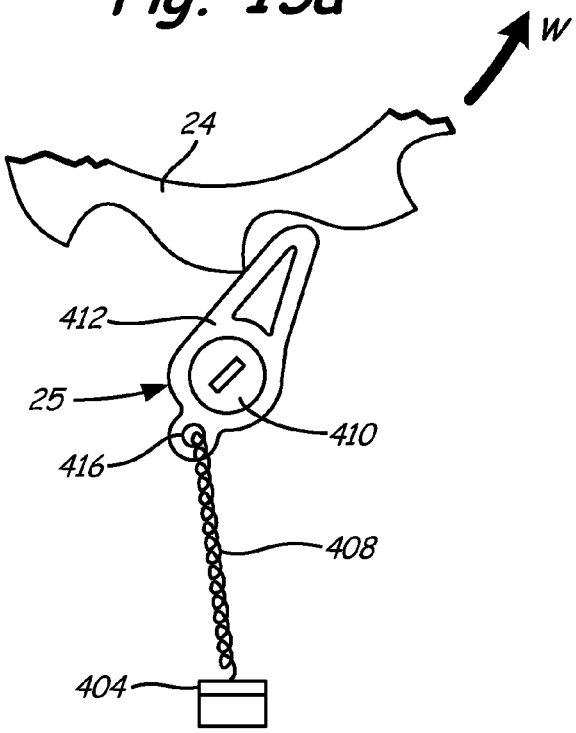

FIGS. 15*a* and 15*b* illustrate pawl 25 engaging ratchet element 24. FIGS. 15*a* and 15*b* show ratchet element 24, pawl 25 (with pawl body 412 and spring hole 416), spring mount 404, spring 408, and bolt 410. Spring mount 404 may be either spring mount 404*a* or spring mount 404*b*. As previously discussed, bolt 410 mounts pawl 25 on either frame 14 or guide arm 16. Spring 408 stretches between spring hole 416 in pawl body 412 and spring mount 404*a* or 404*b*. Pawl body 412 rotates about bolt 410 when in contact with ratchet element 24, stretching spring 408 so that spring force tends to retain pawl 25 against ratchet 24. Whether ratchet pawl 25 engages with ratchet element 24 to prevent rotation in the W direction depends on the direction from which ratchet element 24 rotated into alignment with pawl 25. This direction determines whether pawl 25 is angled toward the UW direction (as in FIG. 15*a*) or toward the W direction (as in FIG. 15*b*).

FIG. 15*a* shows pawl 25 having rotated in the UW direction into alignment with ratchet element 24. Accordingly, pawl 25 will catch with the teeth of ratchet element 24 to prevent spool 12 from rotating in the W direction, so long as ratchet element 24 remains aligned with pawl 25. FIG. 15*b* shows pawl 25 having rotated in the W direction into alignment with ratchet element 24. The angle of the teeth of ratchet element 24 relative to pawl 25 prevents pawl 25 from catching on ratchet element 24, in FIG. 15*b*. When pawl 25 catches on ratchet element 24 (FIG. 15*a*), pawl 25 can be disengaged by rotating spool 12 in the UW direction until ratchet element 24 is no longer aligned with pawl 25, whereupon spool 12 may rotate freely in the W direction, without pawl 25 catching ratchet element 24 (FIG. 15*b*). This functionality is the same, whether pawl 25 is mounted on frame 14 or guide arm 16.

When hose 18 is fully extended from spool 12, hose 18 stretches directly from hose mount 112 to hole 20 in guide arm 16 (see FIGS. 1*a* and 1*b*). By mounting ratchet element 24 on the radially opposite side of spool 12 from hose mount 112 (see FIG. 2*a*), it is therefore possible to ensure that ratchet element 24 never aligns with guide arm 16 while hose 18 is fully extended. If pawl 25 is installed on guide arm 16 (at latch mount 402*b*), spool 12 can never be latched into a position from which it cannot unlatch due to a lack of play in the hose. For this reason, it is advantageous to mount pawl 25 on guide arm 16.

For some applications, however, guide arm 16 may not be used. In such cases, pawl 25 cannot be mounted on (absent) guide arm 16, and must instead be mounted on frame 14. Although frame 14 is a less desirable location for pawl 25 than guide arm 16 for the reasons described above, frame 14 is an acceptable alternative location for pawl 25.

VI. Conclusion

The hose reel described herein provides several advantages. Ridging on frame 14 and guide arm 16 strengthens hose reel 10 against bending, and inward-facing flanges 30 provide stability and strength without increasing hose reel bulk. The spool shape of the present invention makes use of the natural stacking profile of coiled hose to minimize bulk and improve durability without restricting hose movement. The axially inward-sloped sides of hose reel spool 12 provide increased strength without additional spool width, and allow spool 12 to be mounted frame 14 despite axially inward-facing support flanges 30, for a strong, compact hose reel assembly.

Constructing frame 14 and guide arm 16 from L-shaped and I-shaped pieces simplifies the assembly of hose reel 10 and allows easy access to spool 12. Spool 12 can be removed by unscrewing fasteners 322 and 216 from guide arm 16 and frame 14, respectively, and disconnecting mounting hardware 23 from mounting point 310. I-shaped piece 34 and frame side 28*b* can then be removed, allowing spool 12 to be detached from fastening hardware 23. Installing spool 12 follows the opposite procedure: spool 12 is first attached to fastening hardware 23, then frame side 28*b* and finally I-shaped piece 34 are fastened in place on base 26 and L-shaped piece 32 with fasteners 216 and 322, respectively.

By providing attachment points for pawl 25 and spring 408 on both guide arm 16 and frame 14, the present invention allows hose reel 10 be used with or without guide arm 16, while enabling optimal latch placement for either case. Latch assembly 400 is manufactured identically, whether attached to guide arm 16 or frame 14. A user can quickly and easily swap latch assembly 400 from frame 14 to guide arm 16, or vice versa, by removing bolt 410 from pawl mount 402*a* or 402*b* and detaching spring 408 from spring mount 404*a* or 404*b*.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A hose reel comprising:

a hose spool for coiling hose, the hose spool having a ratchet element;

a frame for supporting the hose spool, the frame having a first latch hookup;

a guide arm supported by the frame, for guiding hose into the hose spool, the guide arm having a second latch hookup; and a latch assembly for catching the ratchet element to halt rotation of the hose spool, the latch assembly mountable at either of the first latch hookup and the second latch hookup.

2. The hose reel of claim 1, further comprising a hose mount for attaching hose to the hose spool, wherein the ratchet element is positioned on a region the hose spool radially opposite from the hose mount.

3. The hose reel of claim 1, wherein the latch assembly comprises:

a pawl for catching the ratchet element, the pawl having an attachment hole and a spring hole;

a fastener passing through the attachment hole to mount the pawl at either of the first and second latch hookups; and a spring passing through the spring hole and coupled to the latch hookup to retain the pawl against the ratchet element.

4. The hose reel of claim 3, wherein the first and second latch hookups each comprise:

a pawl mount where the fastener attaches to rotatably anchor the pawl; and a spring mount where the spring attaches to retain the pawl against the ratchet element.

5. The hose reel of claim 4, wherein the spring mount is a tab protruding perpendicularly from the surface of either the frame or the guide arm.

6. The hose reel of claim 3, wherein the fastener comprises a screw with a cylindrical bushing.

7. The hose reel of claim 3, wherein the pawl is formed of cast metal.

8. The hose reel of claim 1, wherein the ratchet element is a toothed circular arc with teeth that catch the pawl.

9. The hose reel of claim 1, wherein the first latch hookup and the second latch hookup are radially equidistant from an axis of the hose spool.

10. A hose reel comprising:

a hose spool with an hub having an outer cylindrical wall and two axially opposite side walls for retaining hose between the side walls and around the outer cylindrical wall;

a ratchet element affixed to one side wall of the hose spool;

a latch assembly for catching the ratchet element;

a frame for supporting the hose spool, the frame including a first latch hookup capable of mounting the latch assembly; and a guide arm for guiding hose to the hose spool, the guide arm including a second latch hookup capable of mounting the latch assembly.

11. The hose reel frame of claim 10, wherein the first and second latch hookups each comprise a pawl mount and a spring mount.

12. The hose reel of claim 11, wherein the latch assembly comprises:

a pawl with an attachment hole and a spring hole;

a fastener passing through the attachment hole to anchor the pawl at the pawl mount in either the first latch hookup or the second latch hookup; and a spring stretched between the spring hole and the spring mount in either the first latch hookup or the second latch hookup to retain the pawl against the ratchet element.

13. The hose reel of claim 12, wherein the spring mounts of the frame and the guide arm are radially equidistant from an axis of the hose spool.

14. The hose reel of claim 11, wherein the pawl mounts of the frame and the guide arm are radially equidistant from an axis of the hose spool.

15. The hose reel of claim 11, wherein the ratchet element is a toothed circular arc with teeth that catch the pawl.

16. The hose reel of claim 10, wherein the pawl comprises a flanged body with a wide tip and a pocket near the tip.

17. The hose reel of claim 10, wherein the fastener comprises a screw with a cylindrical bushing.

* * * * *